United States Patent [19]

Beshore

[11] Patent Number: 4,586,881

[45] Date of Patent: May 6, 1986

[54] MACHINE HAVING INTEGRAL PISTON AND CYLINDER WALL SECTIONS

[76] Inventor: Craig S. Beshore, 753 Puma Canyon La., Glendora, Calif. 91740

[21] Appl. No.: 470,582

[22] Filed: Feb. 28, 1983

[51] Int. Cl.[4] ..... F04B 19/02; F02B 59/00

[52] U.S. Cl. ..... 417/460; 92/117 A; 92/177; 123/50 A; 123/50 B

[58] Field of Search ..... 92/177, 177 R, 177 A; 123/50 R, 50 A, 50 B; 417/460

[56] References Cited

U.S. PATENT DOCUMENTS

| | | | |
|---|---|---|---|
| 621,916 | 3/1899 | Gately | 92/177 |
| 1,133,896 | 3/1915 | Van Houten, Jr. | 123/50 R |
| 1,270,295 | 6/1918 | Husted | 123/50 R |
| 1,273,728 | 7/1918 | Burd et al. | 92/117 |
| 1,281,669 | 10/1918 | Sawyer | 123/50 R |
| 1,360,690 | 11/1920 | Sawyer | 123/50 R |
| 2,067,171 | 1/1937 | Beard | 123/64 |
| 2,458,672 | 1/1949 | Zoch, Jr. | 123/50 R |
| 3,910,242 | 10/1975 | Hom et al. | 123/57 R |

*Primary Examiner*—Leonard E. Smith

*Attorney, Agent, or Firm*—Boniard I. Brown

[57] ABSTRACT

A compact lightweight engine or pump is constructed having a H-shaped piston, usually double acting. Each end of the piston has extending surfaces which form two moving sidewalls which act with two case sidewalls and a block-shaped head protrusion to define a working chamber with the appropriate top surface of the piston which moves to extract or add energy to the working chamber. Energy is transferred between the piston and a crankshaft by means of a slide block on the crankshaft and the inner surfaces of a pair of parallel walls forming the center of the "H" of the piston, whose opposite surfaces form the piston top surfaces. Through the use of suitable cams and valves, 4-cycle, 2-cylinder equivalent engines can be produced. With suitable porting, baffles, and/or auxillary compression means, 2-cycle engines can also be produced as well as air pumps. The planar walls of the devices maximize displacement while the planar design reduces mechanical stress allowing coatings of heat resistant materials such as ceramic for thermal protection rather than extensive cooling systems.

20 Claims, 20 Drawing Figures

MACHINE HAVING INTEGRAL PISTON AND CYLINDER WALL SECTIONS

BACKGROUND OF THE INVENTION

Reciprocating engines and pumps heretofore have been constructed with cylindrical pistons riding in fixed cylinder walls connected to a crankshaft by relatively long connecting rods. Due to the cylindrical nature of their construction and the space taking connecting rods, none of these devices can provide a machine which can process a maximum amount of air for its size and weight and yet be efficient. It has heretofore been known that cube or box shaped structures are very efficient for a given volume, but heretofore this principle has not been employed in engine design. Also prior art engines and pumps are mechanically stressed during operation to such an extent that ceramic or other heat resistant materials cannot be used successfully therewith. Therefore, they must be operated at relatively low temperatures, which result in low efficiencies.

SUMMARY OF THE INVENTION

A machine is provided which can be used as a 2-cycle or 4-cycle diesel or gasoline engine, or a pump. In its basic form, it employs two working chambers with a double acting piston having a rectangular cross-section therebetween. In elevation, the double acting piston is generally H-shaped providing in the middle thereof the surfaces against which gas pressure operates. The H-shaped piston is reciprocated by a crankshaft passing through and sliding transversely in the center section thereof. The piston is supported for linear reciprocating movement against the sides of the case of the machine by suitable bearings. The two opposite sides of the machine case provide two of the facing sides of the working chambers while the legs of the H-shaped piston provide the opposite facing sides. The heads for both working chambers extend down within the "H" structure and include valves and suitable ports when 4-cycle machines are constructed. Otherwise, when 2-cycle machines are constructed, suitable ports can be provided which are covered and uncovered by seals within the machine at the appropriate time. This can be done either using the H-shaped piston as a double acting piston or using one side of it to provide crankcase compression to feed the remaining working chamber.

Since the working chambers are formed with planar walls which can be supported against flexture, the surfaces thereof can be treated with heat resistant-material. This allows the devices to be run at higher temperatures than is common for prior art engines and pumps. This makes the devices more thermodynamically efficient as large quantities of waste heat need not be extracted by a cooling system to maintain low operating temperatures, the heat instead being converted into work within the device.

It is therefore an object of the present invention to provide an engine or pump having rectangular combustion or compression chambers which can accommodate most common engine cycles of operation.

Another object is to provide a mechanical, thermodynamic conversion device which can be constructed to operate at high temperatures.

Another object is to provide a compact engine adapted to accommodate and withstand high pressures.

Another object is to provide an engine which is only about half the size of a conventional engine with the same displacement.

Another object is to provide an engine with external bearings which can be extended as desired for sizing for any pressure so that the displacement volume is independent of bearing requirements.

Another object is to provide a device which can process a maximum of air for its size and weight and yet be efficient.

These and other objects and advantages of the present invention will become apparent to those skilled in the art after considering the following detailed specification which covers preferred embodiments thereof in conjunction with the accompanying drawings wherein:

DETAILED DESCRIPTION OF THE SHOWN EMBODIMENTS

Figure 1:
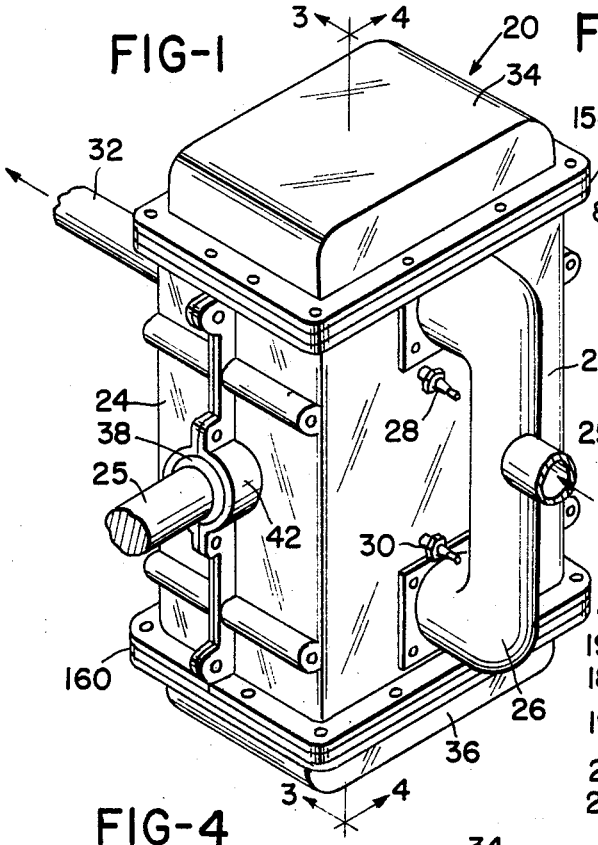
FIG. 1 is a perspective view of a 4-cycle single double acting piston, gas engine constructed according to the present invention.

Referring to the drawings more particularly by reference numbers, number 20 in FIG. 1 refers to an engine constructed according to the present invention. As shown, the engine 20 includes opposite side split case members 22 and 24 across which a crankshaft 25 extends for harnessing the power output of the engine 20. The intake case member 22 includes an intake manifold 26 and suitable ignition means, such as the spark plugs 28 and 30, shown, whereas the exhaust case member 24 includes an exhaust manifold 32. The upper and lower portions of the case members 22 and 24 are covered by valve covers 34 and 36.

Figure 3:
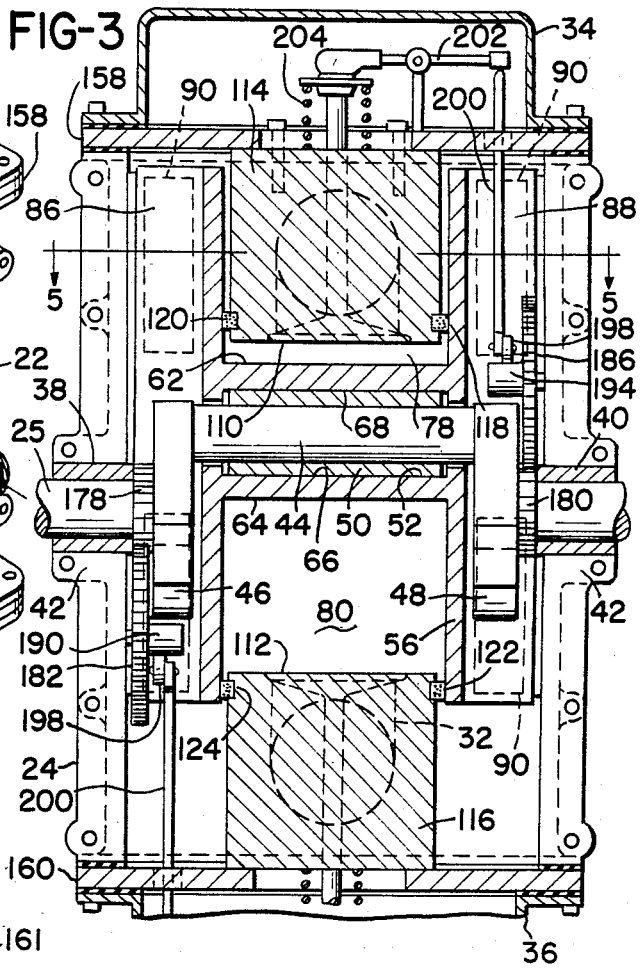
FIG. 3 is a view taken on line 3—3 of FIG. 1.
Figure 2:
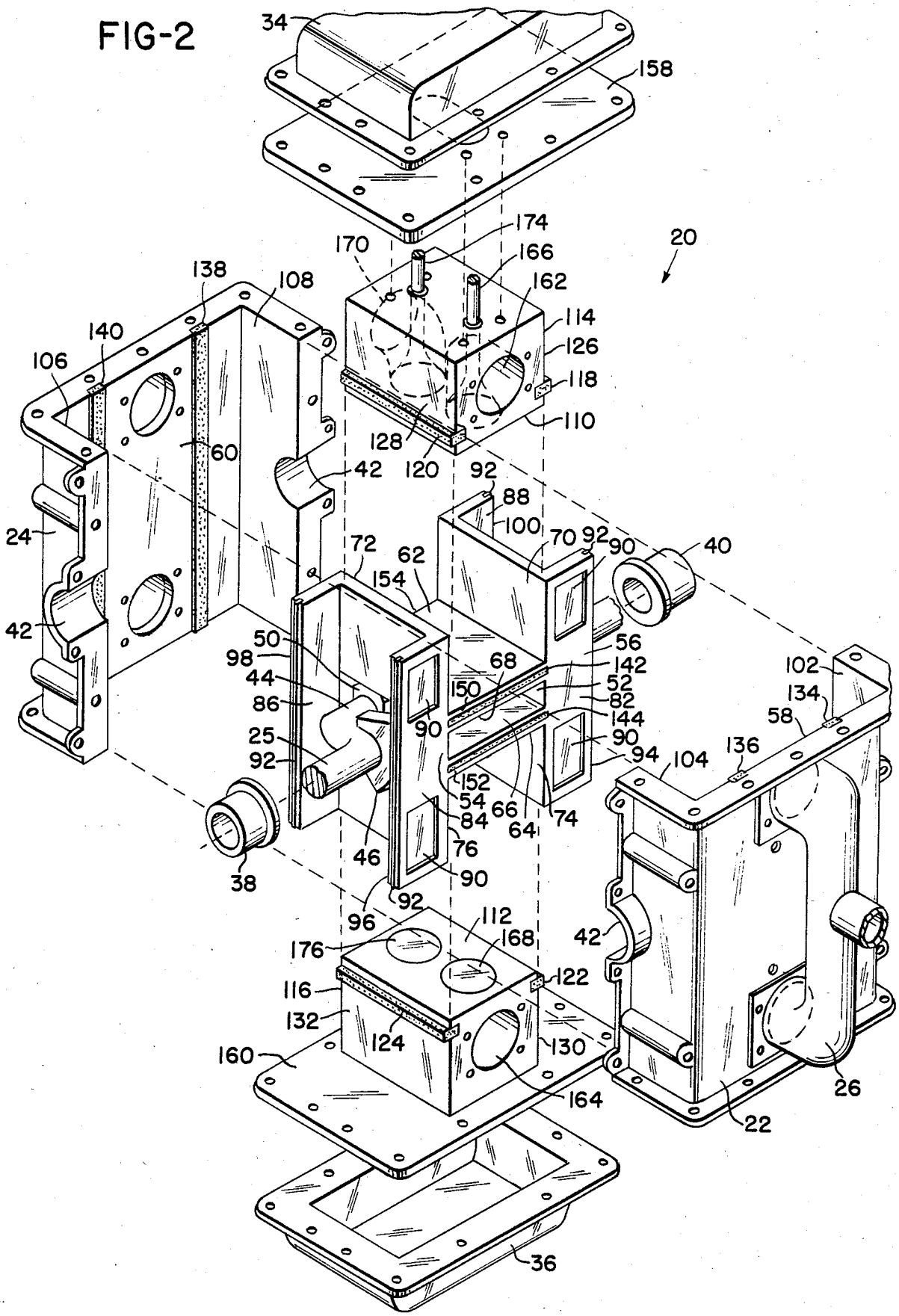
FIG. 2 is an exploded simplified view of the engine of the FIG. 1.
Figure 6A:
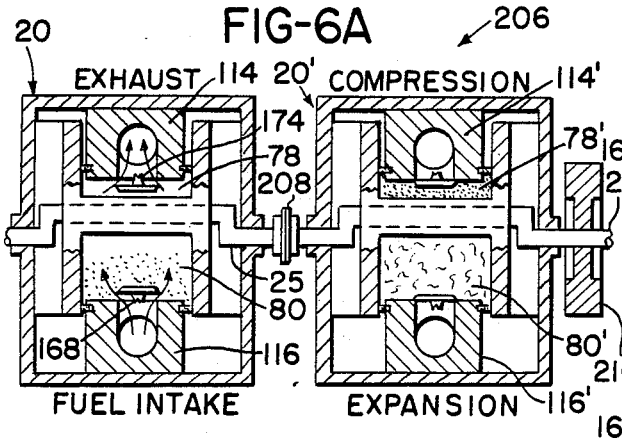
FIGS. 6A, 6B, 6C and 6D are diagrammatic views of a pair of units constructed in accordance with FIGS. 1 through 5 coupled together to form a four combustion chamber engine illustrating the 4-cycle nature thereof.
Figure 6B:
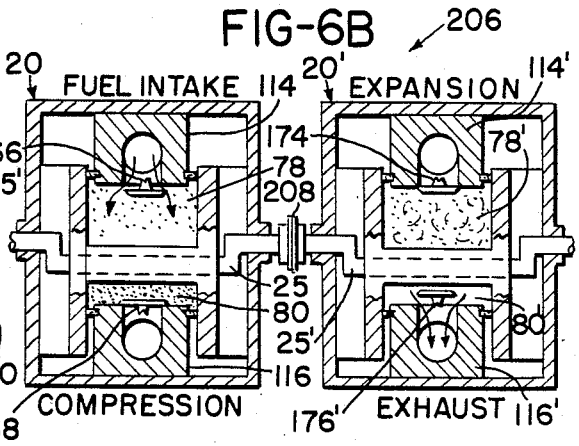
Figure 6C:
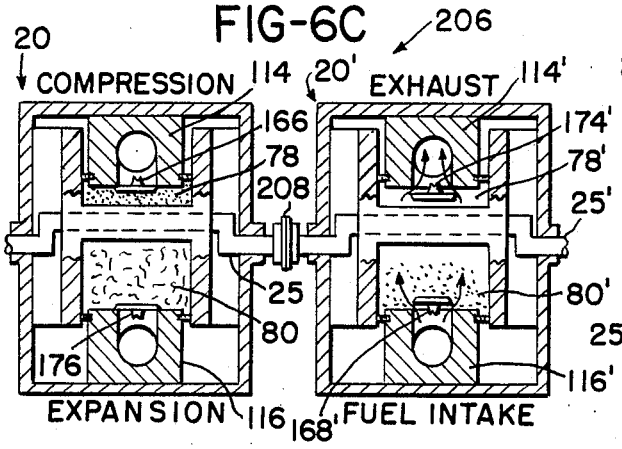
Figure 6D:
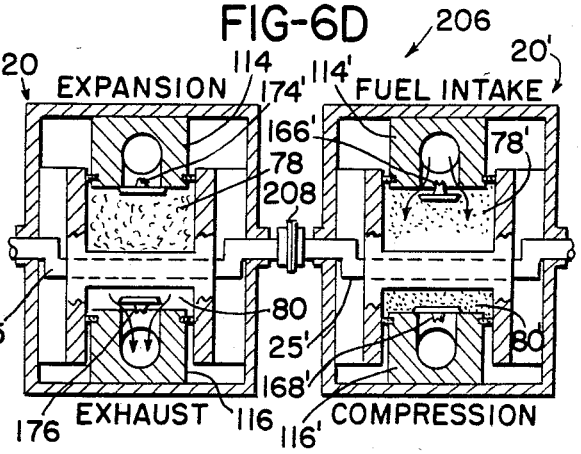

The basic configuration of the engine 20 is more clearly seen from the exploded simplified FIG. 2 wherein the major working portions are shown. The crankshaft 25 is supported on a pair of bearings 38 and 40 which in turn are supported by suitable bearing retainer portions 42 in the case members 22 and 24. The crankshaft 25 includes a crank arm 44 positioned centrally between counterbalances 46 and 48. For ease of assembly the crank arm 44 can be pressed or otherwise suitably connected to the counterbalances 46 and 48 (FIG. 3). A slide block 50 which slides in a transverse passageway 52 (FIGS. 3 and 4) formed centrally across the middle 54 of an H-shaped piston 56 is retained on the crank arm 44 when the crankshaft 25 turns to move the piston 56 along the inner sidewalls 58 and 60 of the case members 22 and 24 respectively.

The H-shaped piston 56 is in fact a double piston having two top surfaces 62 and 64 against which combustion products can act to convert the energy of expanding gas into torque of the crankshaft 25. These top surfaces 62 and 64 generally define the cross or center portion 54 of the H-shaped piston 56 and are generally parallel to the side plane surfaces 66 and 68 of the transverse passageway 52 in which the crankshaft 25 is operatively connected to the piston 56.

The piston 56 also includes two pairs of generally parallel, upstanding walls 70 and 72, and 74 and 76 which extend away from the top surfaces 62 and 64 respectively. The pairs of sidewalls 70 and 72, and 74 and 76 form two of four sidewalls of combustion chambers 78 and 80 respectively which have a rectangular cross-section and whose opposite sides are formed by the sidewalls 58 and 60 of the case members 22 and 24. As shown, the sidewalls 70, 72, 74 and 76 are buttressed by transverse walls 82, 84, 86 and 88 on which are located bearings 90 so that the piston 56 can slide along the sidewalls 58 and 60 of the case members 22 and 24 without undue friction. Additional bearings 92 are provided in the edges 94, 96, 98 and 100 of the buttressed walls 82, 84, 86 and 88 to position the piston 56 properly on the crank arm 44 and to prevent friction with the adjacent end walls 102, 104, 106 and 108 of the case members 22 and 24. The sixth wall of each combustion chamber 78 and 80 is provided by the inwardly facing surface 110 and 112 of valve blocks 114 and 116 respectively which nest between the sidewalls 58 and 60 to which they are attached and the sliding sidewalls 70 and 72 and 74 and 76 of the piston 56.

Suitable linear seals 118 and 120, and 122 and 124 are provided in the sidewalls 126 and 128 of the valve block 114 and 130 and 132 of the valve block 116 to prevent the passage of combustion products therepast as the piston 56 is moved with respect thereto. The seals 118, 120, 122 and 124 act respectively against sidewalls 70, 72, 74 and 76. Seals 134, 136, 138 and 140 are also provided in the sidewalls 58 and 60 which extend in the direction of the movement of the piston 56 to seal the sidewalls 58 and 60 to the buttressed walls 82, 84, 88 and 86. The last remaining escape route for combustion gases is closed by seals 142, 144, 146 and 148 (FIG. 4) which are positioned in the side edges 150, 152, 154, and 156 between the top surface 62 and the side plane surface 68, and the top surface 64 and the side plane surface 66 respectively.

Figure 4:
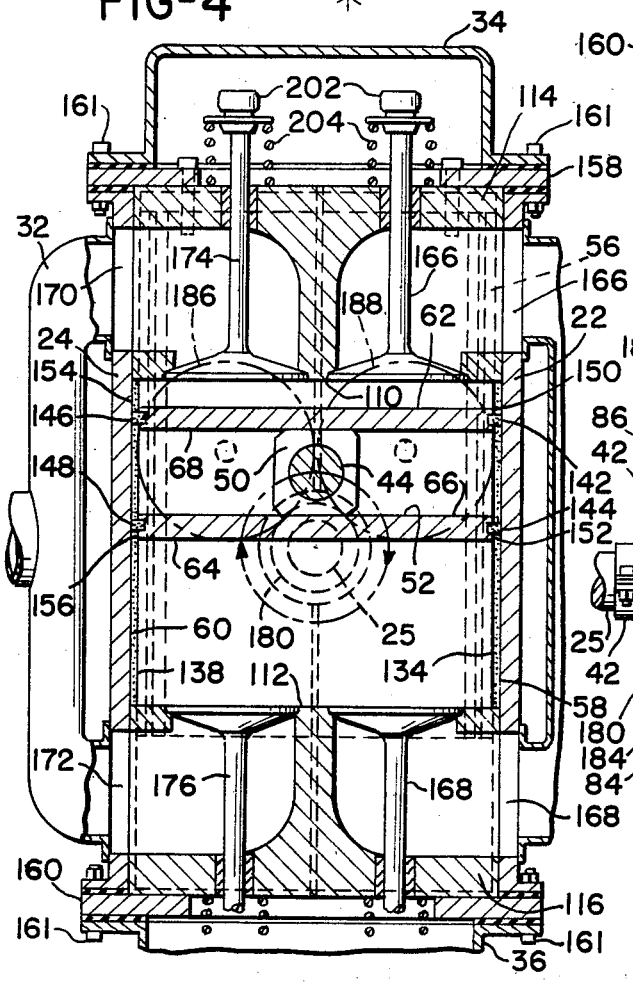
FIG. 4 is a cross-sectional view taken on line 4—4 of FIG. 1.

The valve blocks 114 and 116 are also connected to head plates 158 and 160 respectively through which they are connected to the split case members 22 and 24 by suitable fasteners 161 (FIG. 4). The valve blocks 114 and 116 each include an intake port 162 and 164 being selectively blocked by an intake valve 166 and 168, the intake ports 162 and 164 being connected to be fed gases for combustion by the intake manifold 26. The valve blocks 114 and 116 also include exhaust ports 170 and 172 (FIG. 4) in communication with the exhaust manifold 32 for allowing the escape of combustion products once their energy has been expended in moving the piston 56 as allowed by suitable exhaust valves 174 and 176 therein.

Figure 5:
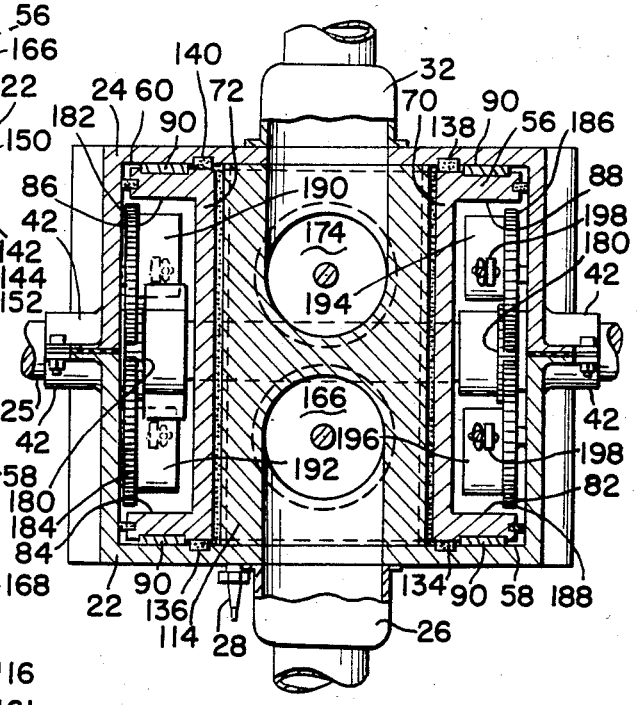
FIG. 5 is a cross-sectional view taken at line 5—5 of FIG. 3.

The valves 166, 168, 174 and 176 are driven from the crankshaft 25 by means of a pair of driving gears 178 and 180 which in turn rotate driven gears 182 and 184, and 186 and 188, respectively, as shown in FIG. 5 at half the crankshaft speed. Each of the driven gears 182, 184, 186 and 188 has an associated cam 190, 192, 194 and 196 connected thereto for rotation with the driven gear. The cams 190, 192, 194, and 196 operate the valves 166, 168, 174 and 176 by means of cam followers 198 push rods 200, and rocker arms 202 in the conventional manner, then depressing the valves 166, 168, 174 and 176 against their springs 204 which normally hold them closed.

The engine 20 of FIGS. 1 thru 5 is shown in a duplicated or four combustion chamber design 206 in FIG. 6. The engine 206 includes a pair of identical engines 20 and 20' coupled together by a suitable coupling 208. Also shown is a flywheel 210 to carry the engine 206 past dead center. As shown in FIG. 6A, there is an intake cycle as shown with combustion chamber 80, a compression cycle as shown with chamber 78', an expansion cycle as shown in chamber 80' and an exhaust cycle as shown in chamber 78. When the crankshaft 25 and 25' rotates 180', as shown in FIG. 6B, the exhaust valve 174 and the intake valve 168 close, whereas the valves 166 and 176' open so that chamber 80 is switched from the fuel intake cycle to a compression cycle, chamber 78' is switched from the compression cycle to an ignition and expansion cycle, chamber 80' is switched from an expansion cycle to an exhaust cycle and chamber 78 is switched from an exhaust cycle to a fuel/air intake cycle. With another 180° turn of the crankshafts 25 and 25', the intake valve 166 and exhaust valve 176 close and intake valve 168' and exhaust valve 174' open so that chamber 80 is in an expansion cycle, chamber 78' is in an exhaust cycle, chamber 80' is in an intake cycle, and chamber 78 is in a compression cycle. With the final turn of 180° of the crankshafts 25 and and 25', each of the chambers 78 and 78' and 80 and 80' has gone through 4 cycles with intake valve 168' closed, exhaust valve 174' closed, intake valve 166' open, and exhaust valve 176 open so that the chamber 80 is in an exhaust cycle, the chamber 78' is in an intake cycle, the chamber 80' is in a compression cycle and the chamber 78 is in an expansion cycle. As long as fuel, air and a source of ignition is present, the cycles as shown in FIGS. 6A through 6D will continue indefinitely, producing a power output on the crankshafts 20 and 25' of the engine 206.

Figure 7:
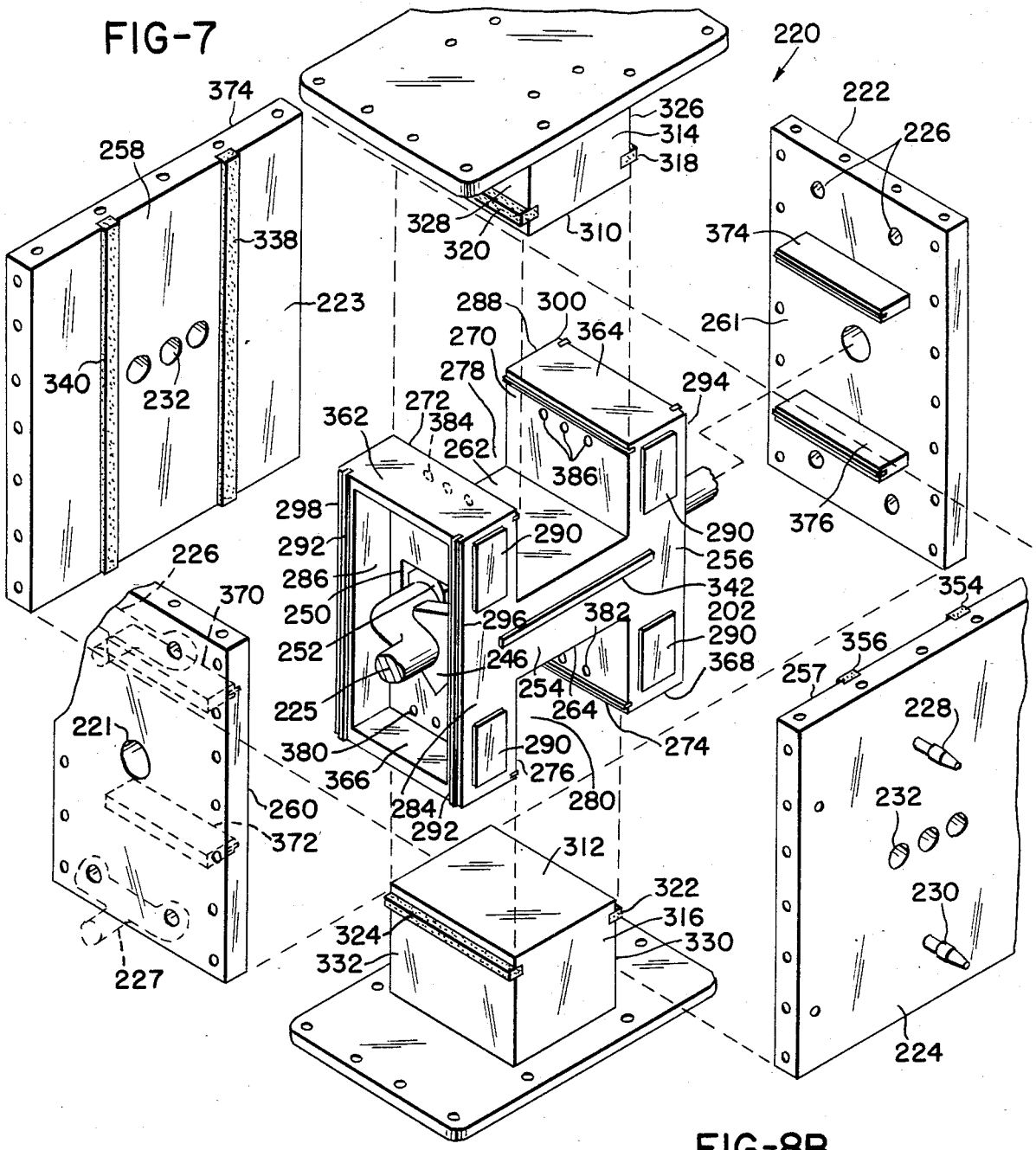
FIG. 7 is an exploded view of a 2-cycle engine constructed on the same principle as the engine of FIGS. 1 through 5 only adapted to a 2-cycle design.

A modified engine 220 adapted for 2-cycle operation is shown in FIG. 7. The engine 220 includes opposite side-split case members 221 and 222, and 223 and 224. The crankshaft 225 for harnessing the power output of the engine 220 extends between case members 221 and 222. The case members 221 and 222 also include upper and lower pluralities of intake manifolds 226 and 227 while the case member 224 includes suitable ignition means such as the spark plugs 228 and 230 shown. Both case members 223 and 224 include a plurality of exhaust ports 232. The crankshaft 225 includes a crank arm 244 positioned centrally between counterbalances 246 which balance the crank arm 244 and a slide block 250 mounted on the crank arm 244. The crank arm 244 is usually detachable from the counterbalance portions 246 of the crankshaft 225 so the engine 220 can be assembled. The slide block 250 slides in a transverse passageway 252 centrally across the middle 254 of an H-shaped piston 256 so that when the crankshaft 225 turns, it moves the piston 256 along the inner sidewalls 258 and 257 of the case members 223 and 224 and sidewalls 260 and 261 of case members 221 and 222 respectivley. The H-shaped piston 256 is similar to piston 56 discussed above having two top surfaces 262 and 264 against which compression products can act to convert the energy of expanding gas into torque of the crankshaft 225. These top surfaces 262 and 264 generally define the cross or center portion 254 of the H-shaped piston 256. The details of the sliding connection between the slide block 250, the crankshaft 225, and the piston 256 are essentially identical to those for engine 20.

The piston 256 also includes two pairs of generally parallel walls 270, 272, and 274 and 276. The pairs of sidewalls 270 and 272, and 274 and 276 form two of four sidewalls of combustion chambers 278 and 280 respectively which have a rectangular cross section and whose opposite sides are formed by the sidewalls 258 and 259 of the case members 223 and 224. As shown, the sidewalls 270, 272, 274 and 276 are buttressed by transverse walls 282, 284, 286 and 288 on which are also located bearings 290 so that the piston 256 can slide along the sidewalls 258 and 259 of the case members 223 and 224 without undue friction. Additional bearings 292 which also must act as seals are provided in the edges 294, 296, 298 and 300 of the buttress walls 282, 284, 286 and 288 to position the piston 256 properly on the crank arm 244 and to prevent friction with the adjacent end walls 260 and 261 of the case members 221 and 222. Like before, the sixth wall of each block-shaped combustion chamber 278 and 280 is provided by the inwardly facing surfaces 310 and 312 of head blocks 314 and 316 respectively which nest between the sidewalls 258 and 259 to which they are attached and the sliding sidewalls 270 and 272, and 274 and 276 of the piston 256. Suitable linear seals 318 and 320, and 322 and 324 are provided in the sidewalls 326 and 328 of the head block 314 and sidewalls 330 and 332 of the head block 316 to prevent the passage of combustion products therepast as the piston 256 is moved with respect thereto. The seals 318, 320, 322 and 324 act against sidewalls 270, 272, 274 and 276 respectively. Seals 334, 336, and 338 and 340 are also provided in the sidewalls 259 and 258. These seals extend in the direction of the movement of the piston 256 to seal the sidewalls 258 and 259 to the buttressed walls 282, 284, 286 and 288. The last remaining escape route for combustion gases is closed by seals 342 which extend tranversely across the center portion 254 of the H-shaped piston 256.

Figure 8A:
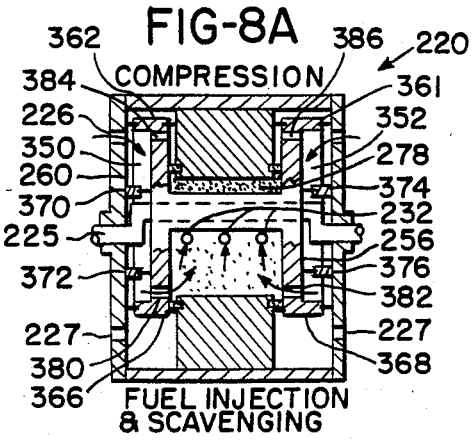
FIGS. 8A and 8B are diagrammatic views of the engine of FIG. 7 showing its operating cycle.
Figure 8B:
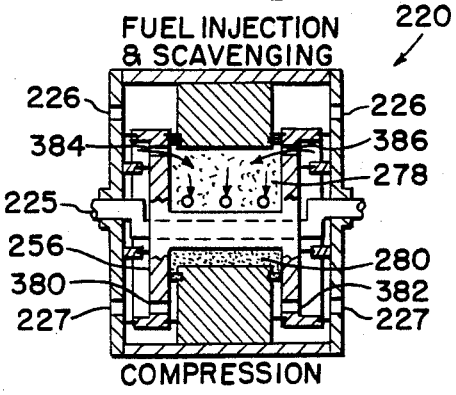

The two-cycle operation of the engine 220 in FIG. 7 can be seen in FIGS. 8A and 8B. With the crankshaft 225 in its top dead center position, the combustion chamber 278 is filled with compressed air and fuel for ignition by the spark plug 228. At the same time, a fresh charge of fuel and air is being drawn into intake chambers 350 and 352 formed respectively by end walls 260 and 261. The sidewalls 358 and 360 of the piston 256, the buttress sidewalls 282, 284, 286 and 288, the top end cap walls 362, 364, 366, and 368 of the piston 256 and baffles 370, 372, 374 and 376 which extend inwardly from the end walls 260 and 261 respectively. As shown in FIG. 8A, when chamber 278 is in a compression cycle, chambers 350 and 352 are in expansion modes, drawing fuel air mixture through the intake manifolds 226 and 227 while chambers 354 and 356 are in compression modes forcing fuel and air through ports 380 and 382 through the piston 256 which are unblocked by movement therepast of the seals 322 and 325 to inject fuel in the chamber 280 while removing the burned residue out of the exhaust ports 232.

Figure 9A:
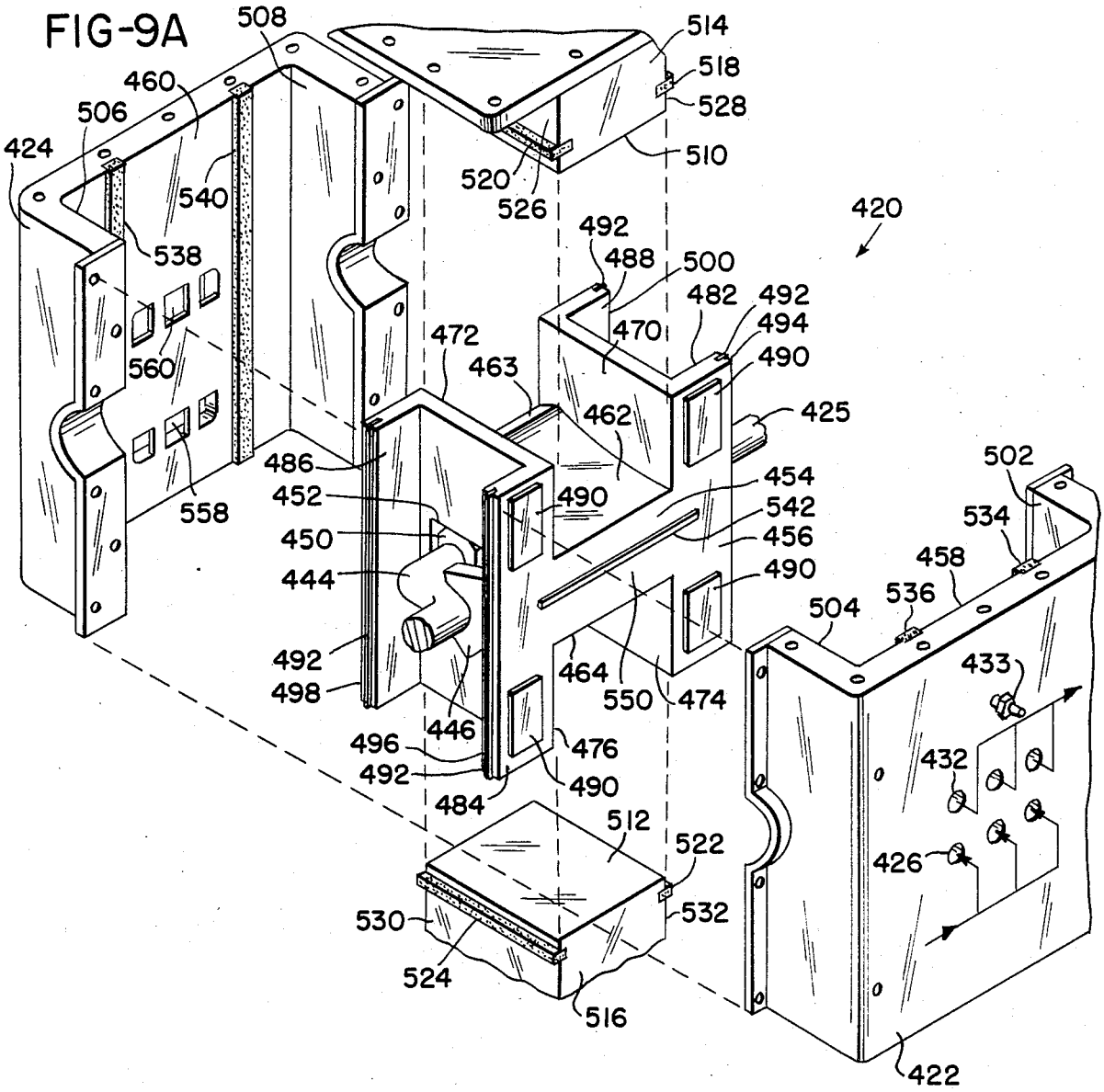
FIG. 9A is an exploded view of a 2-cycle diesel machine constructed according to the present invention with a single acting H-piston and loop scavenging.

The cycle reverses once the crankshaft 225 has been rotated through 180° as shown in FIG. 8B with chambers 350 and 352 being in a compression mode having closed off from the intake manifolds 226 to force the fuel air mixture in through ports 384 and 386 in the piston 256 while spent gases are forced out of the exhaust ports 232. Chamber 280 at this point is in the compression mode ready to be ignited by the spark plug 230 while its next charge of fuel and air is being drawn into chambers 354 and 356 through the intake manifolds 227 which have been opened by passage of the walls 366 and 368. So long as there is a sufficient supply of air, fuel and ignition which, in addition to spark plugs, may be glow ignition or other suitable means, the cycle shown in FIGS. 8A and 8B will continue producing a torque output on the crankshaft 225. Although the engine 220 includes a double acting piston 256, the piston can also be arranged to be single acting as is more conventional in two-stroke design. This is shown for a diesel engine 420 shown in FIGS. 9A, 9B, and 9C.

The engine 420 includes opposite side split case members 422 and 424 across which a crankshaft 425 extends for providing the torque output of the engine 420. The case member 422 includes intake ports 426 and exhaust ports 432 as well as a diesel oil injector 433.

The crankshaft 425 includes a crank arm 444 positioned centrally between counterbalances 446 one of which is shown. For ease of assembly, the crank arm 444 can be pressed or otherwise suitably connected to the counterbalances 446. A slide block 450 is positioned on the crank arm 444 in a transverse passageway 452, formed centrally across the middle 454 of an H-shaped piston 456. When the crankshaft 425 turns to move the piston 456 along the inner sidewalls 458 and 460 of the case members 422 and 424 respectively, the slide block 450 slides with the passageway 452. The H-shaped piston 456, unlike pistons 56 and 256 is a single acting piston having an upper top surface 462 including a smoothly formed deflector vane 463. The top surface 462 is the surface against which combustion products act to convert the energy of the expanding gas into torque of the crankshaft 425. Another surface 464 generally parallel to the surface 462 in combination therewith generally define the cross or center portion 454 of the H-shaped piston 456. The surfaces 462 and 464 are generally parallel to the side plane surfaces 466 and 468 (FIG. 9B) of the transverse passageway 452 in which the crankshaft 425 is operably connected to the piston 456.

The piston 456 also includes two pairs of generally parallel upstanding walls 470 and 472, and 474 and 476 which extend away from the surfaces 462 and 464 respectively. The pairs of sidewalls 470 and 472, and 474 and 476 form two of four sidewalls of combustion and pressure chambers 478 and 480 respectively which have rectangular cross-sections and whose opposite sides are formed by the sidewalls 458 and 460 of the case members 422 and 424. As shown, the sidewalls 470, 472, 474 and 476 are buttressed by transverse walls 482, 484, 486 and 488 on which are located bearings 490 so that the piston 456 can slide along the sidewalls 458 and 460 of the case members 422 and 424 without undue friction. Additional bearings 492 are provided in the edges 494, 496, 498 and 500 of the buttressed walls 482, 484, 486 and 488 to position the piston 456 properly on the crank arm 444 and to prevent friction with the adjacent end walls 502 and 504 and 506 and 508 of the case members 422 and 424. The sixth wall of each of the cubic chambers 478 and 480 is provided by the inwardly facing surfaces 510 and 512 of head blocks 514 and 516 respectively which nest between the sidewalls 458 and 460 to which they are attached and the sliding sidewalls 470, and 472, and 474 and 476 of the piston 456.

Suitable linear seals 518 and 520, and 522 and 524 are provided in the sidewalls 526 and 528 of the head block 514 and the sidewalls 530 and 532 of the head block 516 to prevent the passage of pressurized gas therepast as the piston 456 is moved with respect thereto. The seals 518, 520, 522 and 524 act respectively against sidewalls 470, 472, 474 and 476. Seals 534, 536, 538 and 540 are also provided in the sidewalls 458 and 460 to extend in the direction of the movement of the piston 456 to seal the sidewalls 458 and 460 to the transverse walls 482, 484, 488 and 486. The last remaining escape route for the compressed gasses is closed by seals 542 and 546, which are positioned in the walls 550 and 552 of the piston middle 454 to seal between the surfaces 550 and 458, and 552 and 460 respectively.

Figure 9B:
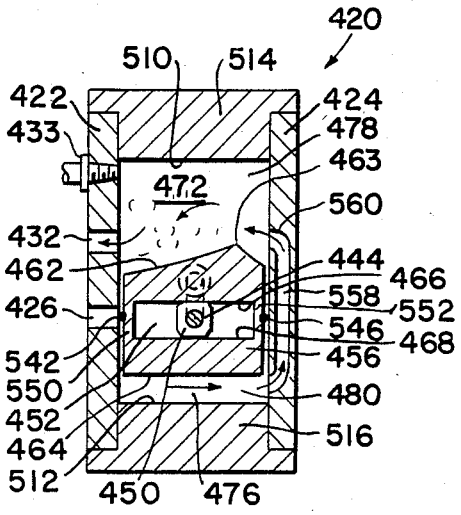
FIG. 9B and 9C are diagrammatic views of the machine of FIG. 9A showing its 2-cycle nature.
Figure 9C:
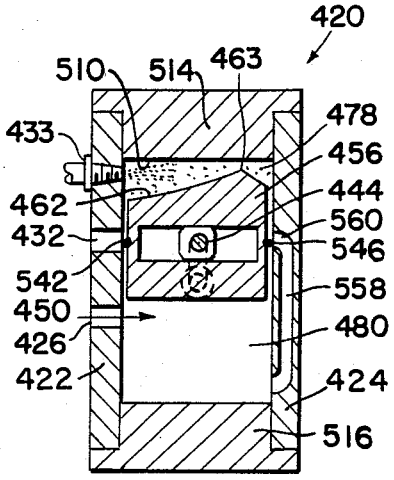

The operation of the engine 420 is shown in greatly simplified form in FIGS. 9B and 9C. With the crankarm 444 in its bottom position shown in FIG. 9B, the chamber 480 is closed off from the intake port 426 by the piston 456. The air compressed therewithin is forced to flow through a bypass passageway 558 whose opposite end 560 is unblocked by the piston 456. The shape of the diverter vane 463 causes this fresh charge of air to flow into the chamber 478 which pushes the spent combustion products from a previous combustion through exhaust ports 432 which are uncovered by the piston 456 at this time. As the piston 456 moves to the position shown in FIG. 9C where it is at approximate top dead center, the end 560 of the passageway 558 is closed as are the exhaust ports 432 so that the fresh air therein is compressed in the chamber 478. At the same time, the intake port 426 is uncovered by the piston 456 so that fresh air is drawn into the chamber 480. Fuel is then injected into the chamber 478 by the injector 433. The fuel immediately ignites, forcing the piston 456 downwardly until it reaches the position shown in FIG. 9B with the crankshaft 425 extractng energy from the expanding gases. So long as fuel and air are available, the cycle will continue.

Although the engine 420 is described as a diesel it could also be other types of engine where fuel and air are drawn in through the intake port 426 and fuel ignition is caused by a spark or glow plug.

Figure 10:
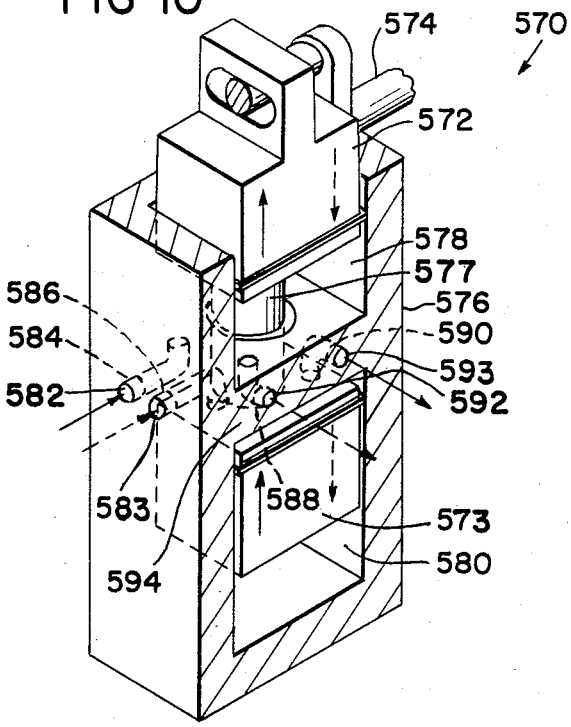
FIG. 10 is a diagrammatic perspective view of the present invention used to provide a double acting pump.

It should be realized that the foregoing engines 20, 206, 220 and 420 can be constructed as pumps if a suitable prime mover is connected to their crankshafts and the sources of fuel and ignition are removed. A further modification is shown in Figure 10 wherein a pump 570 is shown. The pump 570 has a pair of rectangular pistons 572 and 573 reciprocated by a crank 574 while the H-shaped case 576 is stationary. The pistons 572 and 573 are connected together by a rod 577. Movement of the generally boxed-shaped pistons 572 and 573 by means of the crank 574 alternately draws air into chambers 578 and 580 through intake ports 582 and 583 restricted by suitably oriented check valves 584 and 586. As the chambers 578 and 580 alternately go into compression modes, oppositely operating check valves 588 and 590 on exhaust ports 592 and 593, positioned in the center 594 of the H-shaped case 576, cause the compressed gas to flow out.

Figure 11:
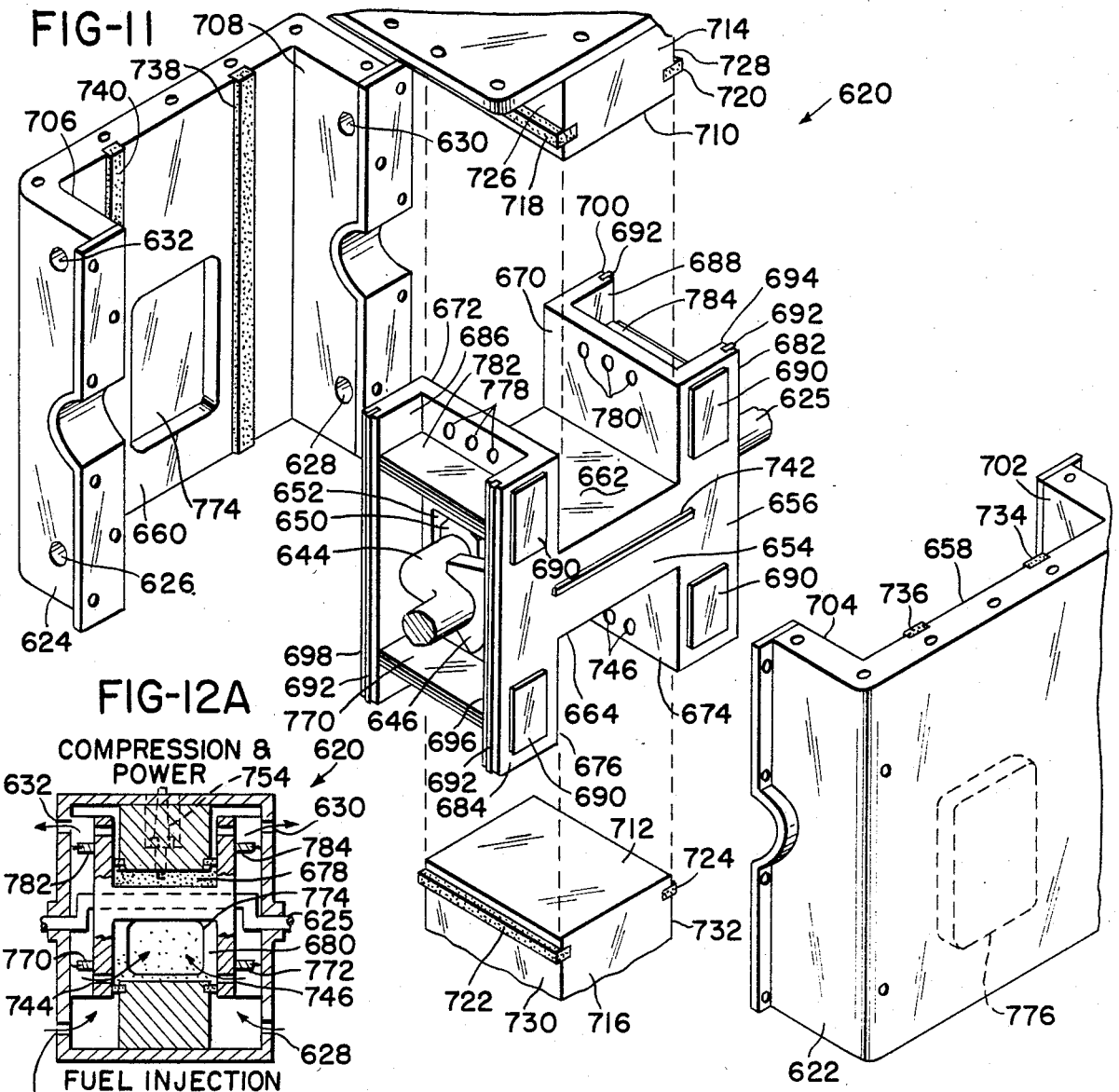
FIG. 11 is an exploded simplified view of a 2-cycle machine with the H-piston used in a single acting mode with loop scavenging.
Figure 12A:
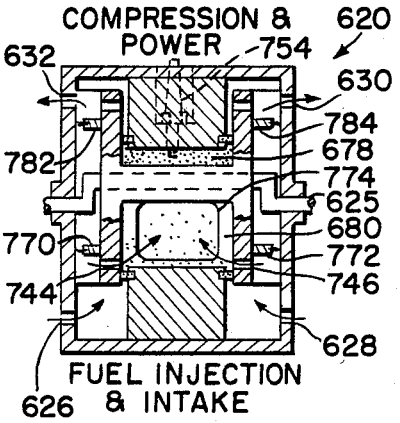
FIGS. 12A and 12B are diagrammatic views showing the operative cycle of the engine of FIG. 11.
Figure 12B:
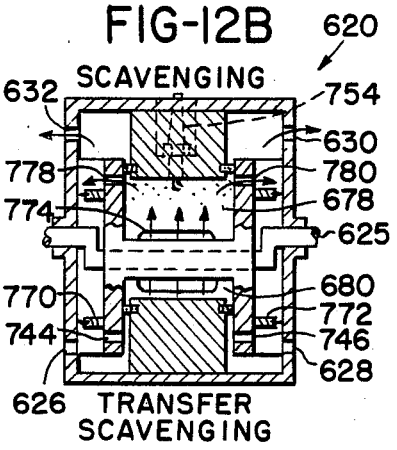

Another two-cycle engine 620 is shown in FIGS. 11, 12A and 12B. The engine 620 includes opposite side, split case members 622 and 624 across which a crankshaft 625 extends for providing the torque output of the engine 620. The case member 624 includes intake ports 626 and 628 and exhaust ports 630 and 632.

The crankshaft 625 includes a crank arm 644 positioned centrally between counterbalances 646, one of which is shown. For ease of assembly, the crank arm 644 can be pressed or otherwise suitably connected to the counterbalances 646 to form the crankshaft 625. A slide block 650 is positioned in a transverse passageway 652 formed centrally across the middle 654 of an H-shaped piston 656. When the crankshaft 625 turns to move the piston 656 along the inner walls 658 and 660 of the case members 622 and 624 respectively, the slide block 650 slides within the passageway 652. The H-shaped piston 656, like piston 456, is a single acting piston. However, its top surface 662, against which combustion products act to convert the energy of the expanding gas into torque of the crankshaft 625, includes no deflection vane. Another surface 664 generally parallel to the surface 662 and in combination therewith generally define the cross or center portion 654 of the H-shaped piston 656.

The piston 656 also includes two pairs of generally parallel upstanding walls 670 and 672, and 674 and 676 which extend away from the surfaces 662 and 664 respectively. The pairs of sidewalls 670 and 672, and 674 and 676 form two of four sidewalls of combustion and pressure chambers 678 and 680 respectively which have rectangular cross-sections and whose opposite sides are formed by the sidewalls 658 and 660 of the case members 622 and 624. As shown, the sidewalls 670, 672, 674 and 676 are buttressed by transverse walls 682, 684, 686 and 688 on which are located bearings 690 so that the piston 656 can slide along the sidewalls 658 and 660 of the case members 622 and 624 without undue friction. Additional bearings 692 are provided in the edges 694, 696, 698 and 700 of the buttressed walls 682, 684, 686 and 688 to position the piston 656 properly on the crank arm 644 and to prevent friction with the adjacent endwalls 702 and 704, and 706 and 708 of the case members 622 and 624. The sixth wall of each of the cubic chambers 678 and 680 is provided by the inwardly facing surfaces 710 and 712 of headblocks 714 and 716 respectively which nest between the sidewalls 658 and 660 to which they are attached and the sliding sidewalls 670 and 672, and 674 and 676 of the piston 656.

Suitable linear seals 718 and 720, and 722 and 724 are provided in the sidewalls 726 and 728 of the headblock 714 and the sidewalls 730 and 732 of the headblock 716 to prevent the passage of pressurized gas therepast as the piston 656 is moved with respect thereto. The seal 718, 720, 722 and 724 act respectively against the sidewalls 670, 672, 674 and 676. Seals 734, 736, 738 and 740 are also provided in the sidewalls 658 and 660 which extend in the direction of the movement of the piston 656 to seal the sidewalls 658 and 660 thereof to the transverse walls 682, 684, 688 and 686. The last remaining escape route for the compressed gases is closed by seals 742 and which are positioned across the middle 654 of the piston 656 to provide a seal to the surfaces 658 and 660 between the seals 734 and 736, and 738 and 740.

The operation of the engine 620 is shown in greatly simplified form in FIGS. 12A and 12B. With the crankshaft 625 in its top dead center position as shown in FIG. 12A, the combustion chamber 678 is filled with compressed air and fuel for ignition by a spark plug 754. At the same time, a fresh charge of fuel and air is being drawn into chamber 680 through intake ports 626 and 628 in the case member endwalls 706 and 708 and intake passageways 744 and 746 formed through the walls 676 and 674 and uncovered by the seals 724 and 722 at that time. Baffles 770 and 772 which extend outwardly from the walls 676 and 674 to seal against the case endwalls 704 and 706, and 702 and 708 prevent this intake flow from mixing with lubricant, not shown, for the crankshaft 625. As the piston 656 moves downwardly to the position shown in FIG. 12B, the intake passageways 744 and 746 are closed off at about the same time a pair of internal blind cavities 774 and 776 provide passageways from chamber 680 to chamber 678. This occurs just after exhaust passageways 778 and 780 in the walls 672 and 670 are uncovered by the seals 720 and 718 which allow the exhaust products to be scavenged out through the exhaust ports 632 and 630. The mixing of these exhaust products with lubricant is prevented by baffles 782 and 784 on the sidewalls 672 and 670 of the piston 656. The fresh charge of air and fuel in chamber 678 is then compressed as shown in FIG. 12A for ignition by the spark plug 754 and the continuation of the cycle.

Figure 13:
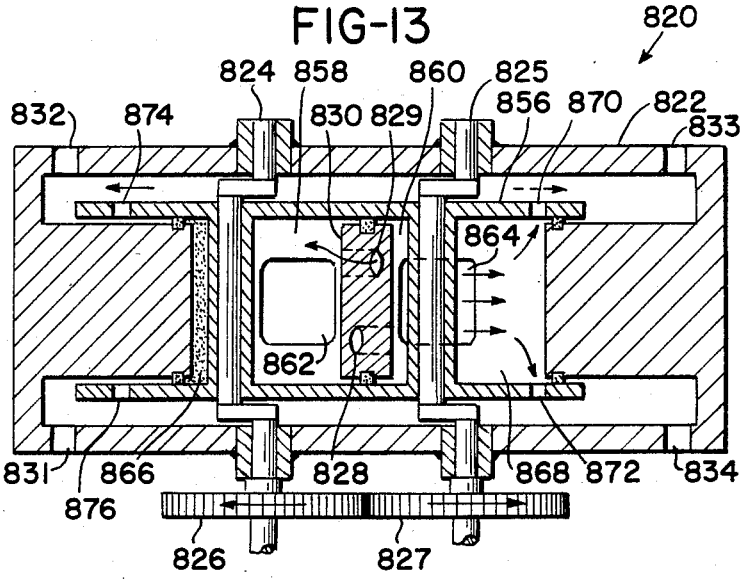
FIG. 13 is a diagrammatic cross-sectional view of a modified version of the present invention utilizing a double H-piston to provide two back-to-back 2-cycle machines like are shown in FIGS. 11, 12A and 12B with one integral piston.

An engine 820 which is essentially two of the engines 620 back-to-back is shown in simplified form in FIG. 13. The engine 820 includes a crankcase 822 across which a pair of crankshafts 824 and 825 extend. The crankshafts 824 and 825 are connected directly together by meshing gears 826 and 827 thereon which force the crankshafts 824 and 825 to rotate in opposite directions when they rotate. The crankcase 822 includes intake ports 828 and 829 in a central member 830 formed thereacross and exhaust ports 831, 832, 833 and 834 through the crankcase walls as are located exhaust ports 630 and 632 in engine 620. Suitable check valves, not shown, can be employed in the intake ports 828 and 829 to allow flow only thereinto.

A double H-piston 856 is mounted on the crankshafts 824 and 825 for reciprocating motion within the case 822. This reciprocating motion alternately causes compression chambers 858 and 860 to pass a fuel air mixture through blind passageways 862 and 864 to combustion chambers 866 and 868. When a combustion chamber such as 868 is receiving a fuel air charge for burning, as shown in FIG. 13, its exhaust passageways 870 and 872 are uncovered allowing flow through the exhaust ports 833 and 834. Of course, at the same time, the other combustion chamber 866 is just commencing compression with its exhaust passageways 874 and 876 sealed off. Therefore, each of the pairs of compression and combustion chambers 858 and 866 and 860 and 868 function as the compression and combustion chambers 680 and 678 in the engine 620.

Thus there has been shown and described novel engines and compressors which fullfill all the objects and advantages sought therefore. Many changes, alterations, modifications and other uses and applications of the subject engines and compressors will become apparent to those skilled in the art after considering this specification together with the accompanying drawings and claims. All such changes, alterations and modifications which do not depart from the spirit and scope from the invention are deemed to be covered by the invention which is limited only by the claims which follow.

What is claimed is:

1. A machine having at least a first working chamber formed by:

a machine case with:

first and second stationary sidewall surfaces facing each other; and a first head surface extending between said first and second stationary sidewall surfaces; and a reciprocating piston having:

a first top surface facing said first head surface; and first and second reciprocating sidewall surfaces extending between said first and second stationary sidewall surfaces and between said first top surface and said first head surface.

2. The machine defined in claim 1 wherein said machine case further includes:

a second head surface extending between said first and second stationary sidewall surfaces positioned spaced from and facing said first head surface, said reciprocating piston being positioned generally between said first and second head surfaces and further including:

a second top surface facing said second head surface; and third and fourth reciprocating sidewall surfaces extending between said first and second stationary sidewall surfaces and between said second top surface and said second head surface, a second working chamber being defined between said second top surface, said second head surface, said first and second stationary sidewall surfaces and said third and fourth reciprocating sidewall surfaces.

3. The machine defined in claim 2 wherein said piston further includes:

first and second parallel facing slide surfaces positioned between said first and second top surfaces thereof, said machine further including:

crankshaft means supported by said machine case and operatively connected for sliding contact with said piston at said first and second parallel facing slide surfaces.

4. The machine defined in claim 3 wherein said first, second, third, and fourth reciprocating surfaces and said first, second, third, and fourth stationary sidewall surfaces are planar surfaces.

5. The machine defined in claim 3 wherein said machine case further includes:

a first head block on which is positioned said first head surface; and a second head block on which is positioned said second head surface.

6. The machine defined in claim 5 wherein said first head block includes:

a first intake port;

a first exhaust port;

a first intake valve positioned in said first intake port to control flow therethrough; and a first exhaust valve positioned in said first exhaust port to control flow therethrough.

7. The machine defined in claim 6, and further including:

valve actuating means connected between said said crankshaft and said first intake and first exhaust valves to actuate said valves in synchronism with rotation of said crankshaft.

8. The machine defined in claim 2 wherein said piston further includes:

a first buttress wall facing said first stationary sidewall surface and supporting said first and third reciprocating surfaces;

a second buttress wall facing said second stationary sidewall surface and supporting said first and third reciprocating surfaces;

a third buttress wall facing said first stationary sidewall surface and supporting said second and fourth reciprocating surfaces; and a fourth buttress wall facing said second stationary sidewall surface and supporting said second and fourth reciprocating surfaces.

9. The machine defined in claim 8 wherein said first buttress wall includes:

bearing means thereon positioned for engagement with said first stationary sidewall surface, said second buttress wall including:

bearing means thereon positioned for engagement with said second stationary sidewall surface, said third buttress wall including:

bearing means thereon positioned for engagement with said first stationary sidewall surface, and said fourth buttress wall including:

bearing means thereon positioned for engagement with said second stationary sidewall surface.

10. The machine defined in claim 9 wherein said machine case includes:

facing third and fourth stationary sidewall surfaces positioned between and perpendicular to said first and second stationary sidewall surfaces, said first buttress wall further including:

an outer edge thereon spaced from said first and third reciprocating surfaces facing said third stationary sidewall surface, said second buttress wall further including:

an outer edge thereon spaced from said first and third reciprocating surfaces facing said third stationary sidewall surface, said third buttress wall further including:

an outer edge thereon spaced from said second and fourth reciprocating surfaces facing said fourth stationary sidewall surface, said fourth buttress wall further including:

an outer edge thereon spaced from said second and fourth reciprocating surfaces facing said fourth stationary sidewall surface.

11. The machine defined in claim 10 wherein said outer edges of said first and second buttress walls include:

seals for sealing against said third stationary sidewall surface, and wherein said outer edges of said third and fourth buttress walls include:

seals for sealing against said fourth stationary sidewall surface.

12. The machine defined in claim 10 wherein said first stationary sidewall surface includes:

a first linear seal for sealing against said first buttress wall; and a second linear seal for sealing against said third buttress wall, and wherein said second stationary sidewall surface includes:

a third linear seal for sealing against said second buttress wall; and a fourth linear seal for sealing against said fourth buttress wall.

13. The machine defined in claim 10 wherein said machine case further includes:

a first head block on which is positioned said first head surface, said first head block including:

first and second side head block surfaces, said first side head block surface including:

a first head block seal positioned for sealing engagement with said first reciprocating sidewall surface, and said second side head block surface including:

a second head block seal positioned for sealing engagement with said first reciprocating sidewall surface; and a second head block on which is positioned said second head surface, said second head block including:

third and fourth side head block surfaces, said third side head block surface including:

a third head block seal positioned for sealing engagement with said third reciprocating sidewall surface, and said fourth side head block surface including:

a fourth head block seal positioned for sealing engagement with said fourth reciprocating sidewall surface.

14. The machine defined in claim 13 wherein said machine case further includes:

first and second intake ports in said third stationary sidewall surface; and at least one exhaust port in said first stationary sidewall surface, and wherein said piston includes:

a first transfer intake port through said first reciprocating sidewall surface; and a second transfer intake port through said third reciprocating sidewall surface.

15. The machine defined in claim 14 wherein said first transfer intake port through said first reciprocating sidewall surface is positioned to open and close a flow path to said intake port by said first head block seal, and said a second transfer intake port through said third reciprocating sidewall surface is positioned to open and close a flow path to said intake port by said third head block seal.

16. The machine defined in claim 13 wherein said machine case further includes:

intake and exhaust ports in said first stationary sidewall surface, said intake port being operatively connected to said second chamber when said piston is in a first predetermined position and said exhaust port being operatively connected to said first chamber when said piston is in a second predetermined position; and a transfer bypass port in said second stationary sidewall surface operatively connecting said first and second chambers when said piston is in the second predetermined position.

17. The machine defined in claim 16 wherein said first top surface of said piston includes a deflector vane.

18. The machine defined in claim 13 wherein said machine case further includes:

a bypass cavity in said second stationary sidewall surface for selectively comunicating said first and second chambers;

an intake port in said third stationary sidewall surface; and an exhaust port in said third stationary sidewall surface, and wherein said piston includes:

a transfer intake port through said third reciprocating sidewall surface; and a transfer exhaust port through said first reciprocating sidewall surface.

19. The machine defined in claim 18 wherein said transfer intake port through said third reciprocating sidewall surface is positioned to open and close a flow path to said intake port by said third head block seal, and said a transfer exhaust port through said first reciprocating sidewall surface is positioned to open and close a flow path to said intake port by said first head block seal.

20. The machine defined in claim 13 wherein said piston further includes:

third and fourth top surfaces facing each other; and fifth and sixth reciprocating sidewall surfaces extending between said first and second stationary sidewall surfaces and between said third and fourth top surfaces, and wherein said machine case further includes:

an intermediate head block having:

a third head surface extending between said first and second stationary sidewall surfaces and facing said third top surface; and a fourth head surface extending between said first and second stationary sidewall surfaces and facing said fourth top surface.

* * * * *